US010450810B2

(12) United States Patent
Mørck

(10) Patent No.: US 10,450,810 B2
(45) Date of Patent: Oct. 22, 2019

(54) RISER TOP CONNECTOR

(71) Applicant: Aker Solutions AS, Lysaker (NO)

(72) Inventor: Morten Rengman Mørck, Oslo (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 15/513,282

(22) PCT Filed: Oct. 7, 2015

(86) PCT No.: PCT/NO2015/050184

§ 371 (c)(1),
(2) Date: Mar. 22, 2017

(87) PCT Pub. No.: WO2016/060566

PCT Pub. Date: Apr. 21, 2016

(65) Prior Publication Data

US 2017/0247955 A1 Aug. 31, 2017

(30) Foreign Application Priority Data

Oct. 13, 2014 (NO) ..... 20141224

(51) Int. Cl.
*E21B 17/01* (2006.01)
*E21B 41/04* (2006.01)
(Continued)

(52) U.S. Cl.
CPC ..... *E21B 17/085* (2013.01); *E21B 17/015* (2013.01); *E21B 17/017* (2013.01); *E21B 43/0107* (2013.01)

(58) Field of Classification Search
None
See application file for complete search history.

(56) References Cited

U.S. PATENT DOCUMENTS 4,878,694 A * 11/1989 Castel ..... E21B 41/04 285/24
8,418,766 B2 * 4/2013 Luppi ..... E21B 43/013 166/345
(Continued)

FOREIGN PATENT DOCUMENTS

GB 2504484 A 2/2014
NO 178901 B 3/1996
(Continued)

OTHER PUBLICATIONS

Westbye, Daniel, "International Search Report," prepared for PCT/NO2015/050184, dated Jan. 6, 2016, three pages.

*Primary Examiner* — Matthew R Buck
*Assistant Examiner* — Douglas S Wood
(74) *Attorney, Agent, or Firm* — Winstead PC

(57) ABSTRACT

A riser top connector assembly (20) is shown. The assembly (20) includes a first connector part (21) arranged on a flexible jumper prepared for connection with a second connector part (40) arranged on top of a marine riser tower assembly projecting from the seabed. The first connector part (21) is provided with suspension means adapted to engage with supporting means in order to be supported and be able to tilt in the marine riser tower assembly. The first connector part (21) includes a housing (22) that receives an extendable termination hub (23) having a clamp connector (24) attached thereto. The jumper termination hub (23) is alignable with a riser hub (44) on the second connector part (40) when the first connector part (21) is being tilted relative to the marine riser tower assembly.

12 Claims, 7 Drawing Sheets

(51) Int. Cl.

| | |
|---|---|
| ***E21B 43/013*** | (2006.01) |
| ***F16L 1/16*** | (2006.01) |
| ***F16L 37/00*** | (2006.01) |
| ***F16L 1/26*** | (2006.01) |
| ***E21B 17/08*** | (2006.01) |
| ***E21B 43/01*** | (2006.01) |

(56) References Cited

U.S. PATENT DOCUMENTS

| | | | | |
|---|---|---|---|---|
| 8,813,851 | B2 * | 8/2014 | Varley | E21B 17/085 166/345 |
| 8,961,070 | B1 * | 2/2015 | Mascarenhas | F16L 1/12 405/170 |
| 9,506,301 | B2 * | 11/2016 | Routeau | E21B 43/0107 |
| 2010/0314123 | A1 | 12/2010 | Luppi | |
| 2012/0090152 | A1 | 4/2012 | White | |
| 2012/0145407 | A1 | 6/2012 | Varley et al. | |

FOREIGN PATENT DOCUMENTS

| | | | |
|---|---|---|---|
| WO | WO-2012076520 | A2 | 6/2012 |
| WO | WO-2012080724 | A2 | 6/2012 |
| WO | WO-2014114890 | A1 | 7/2014 |

* cited by examiner

RISER TOP CONNECTOR

The present invention relates to a riser top connector and more specifically connectors for connecting an FPSO (Floating Production, Storage and Offloading) unit or similar units, to a riser tower assembly via a flexible jumper.

More precisely, the present invention relates to a riser top connector assembly, comprising a first connector part arranged on a flexible jumper prepared for connection with a second connector part arranged on top of a marine riser tower assembly projecting from the seabed, which first connector part is provided with suspension means adapted to engage with supporting means on the second connector part in order to be supported and be able to tilt in the marine riser tower assembly.

A riser top connector assembly of this nature is known from WO 2012/076520. Other example of prior art are US 2012/0090152, US 2010/314123, US 2012/145407, NO 178901, WO 2014/114890 and GB 2504484.

(The riser top connector is adapted to connect a flexible jumper from an FPSO or similar unit to the top of a riser tower. The flexible jumper provides flexibility for mutual movement of the FPSO and riser tower. The jumper hangs in the sea in a catenary from the riser tower assembly to the FPSO.

To ensure stable fluid connection between the end hub of a flexible jumper and the end hub of a riser extending upwards from the seabed, it is known to arrange the riser end hub in a riser tower assembly below the surface. The mechanical connection between the two hubs must withstand large forces. The weight of jumper exerts a significant load onto the connection and as the jumper may be pulled in various directions with respect to the riser tower assembly the load will vary. Such pulls may for instance be the result of weather conditions or water currents.

The present invention provides a riser top connector assembly which ensures that mutual forces between the jumper end hub, at the end of the flexible jumper, and the riser end hub, at the end of the riser, do not appear crosswise to the centre axis of the two end hubs. That is, regardless of which direction in which the flexible jumper is pulled, for instance in a direction straight downwards or a direction closer to the horizontal, the forces between the two end hubs will substantially be directed parallel to the two coaxially arranged centre axes of the two mating end hubs.

THE INVENTION

A riser top connector assembly of the introductory defined kind is provided, which is distinguished in that said first connector part includes a housing that receives an extendable termination hub having a connector attached thereto, which jumper termination hub is alignable with a freely projecting riser hub on said second connector part when said first connector part is being tilted relative to said marine riser tower assembly, said jumper termination hub is extendable towards said riser hub on said second connector part by means of an actuator, said jumper termination hub is, when extended from said first connector part housing, prepared for connection with said riser hub by means of said connector, and said second connector part includes a load carrying frame structure straddling over the respective hubs when connected in order to route the load path away from said hubs and connector when connected.

In this way most of bending moments are relived from the respective hubs and the connector, which should then be far more safe for both rupture and leakages.

The above described coupling motion, which moves the two end hubs from a non-connected state into a connected state, is a combined pivoting and translatory motion between the jumper termination hub structure and the riser tower assembly.

The connector can i.a. be either a clamp connector, a collet connector or a dog type connector.

In one embodiment the actuator will be able to extend the jumper termination hub from the first connector part housing, either by a stroke tool or a pulling tool.

Any suitable tool able to perform a substantially rectilinear displacement of the jumper termination hub is conceivable to use.

Preferably, the jumper termination hub is externally designed with centralizing means, which centralizing takes place and being performed during the extending motion of the jumper termination hub within and relative to the first connector part housing.

Conversely, the first connector part housing can be internally designed with centralizing means, which centralizing takes place and being performed during the extending motion of the jumper termination hub within and relative to the first connector part housing.

In one embodiment, the first connector part and the second connector part can have projecting orienting means, which projecting orienting means mate and engage during final relative motion between the respective connector parts.

In still another embodiment, the stroke tool can be detachably arranged on the first connector part housing and jumper termination hub.

Normally the connector can be operated by means of a torque tool carried by an ROV. Other types of connectors can be actuated by integrated hydraulics or a different kind of ROV tool. Also a diver can operate the connector.

In another embodiment of the invention, the first connector part housing is shortened and omit the orienting means and is internally designed with centralizing means, which centralizing takes place and being performed during the extending motion of the jumper termination hub within and relative to the first connector part housing.

Corresponding to the first aspect of the invention, the embodiment involving the guide rod and alignment funnel combination could also be another type of force-transmitting structure.

EXAMPLE OF EMBODIMENT

Having described the invention in general terms above, a more detailed example of an embodiment will be given in the following with reference to the drawings in which FIG. 1 is a principle view of an FPSO on the sea surface and a prior art riser tower assembly, between which a flexible jumper is extended;

Figure 1:
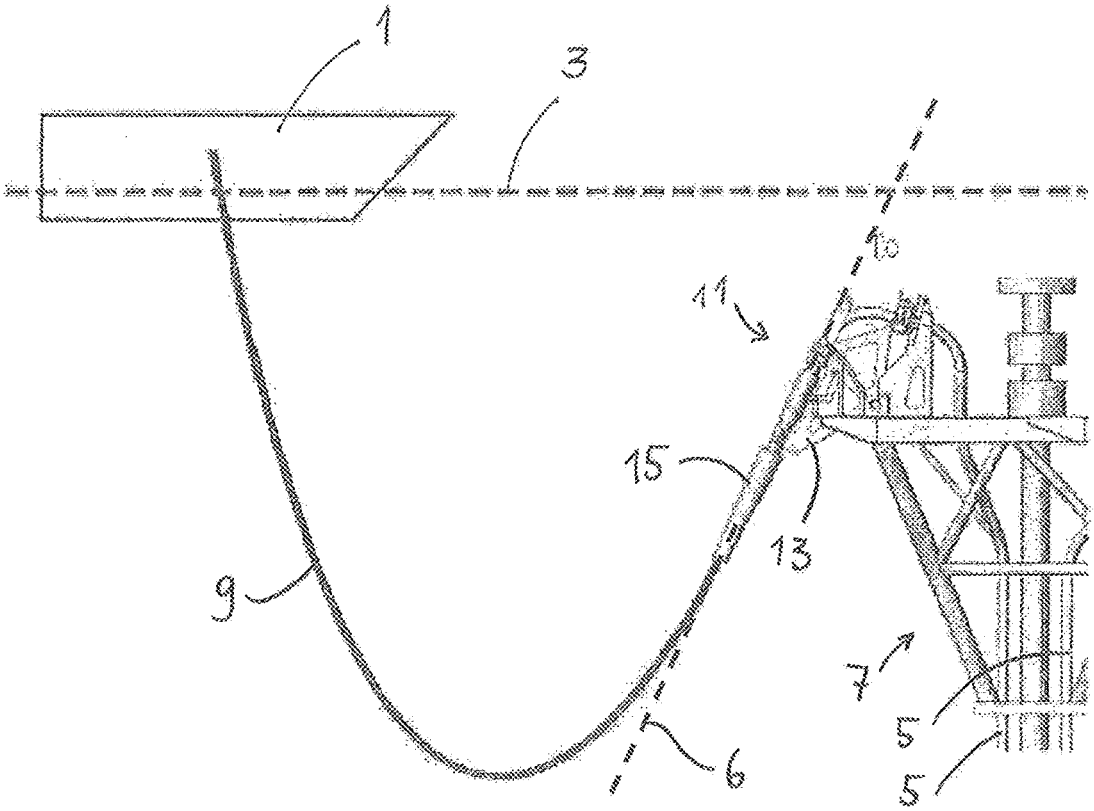

FIG. 1 shows an FPSO 1 floating on the sea surface 3. From the sea floor (not shown) a riser 5 extends up to a prior art riser tower assembly 7. Between the riser tower assembly 7 and the FPSO 1, a flexible jumper 9 is extended and hangs in a catenary shape in the sea. The riser tower assembly 7 may for instance be arranged at a depth of 120 meters. The lower part of the flexible jumper 9 may for instance be at a depth of 300 meters.

It is preferable and beneficial that the flexible jumper 9 hangs in a catenary way between the FPSO and the riser tower assembly 7, and in such a way that the jumper connects to the riser end in an inclined position. If this was a more vertical position, the jumper would have been needed to be much longer, or a substantially higher load would have been experienced in the transition between the riser and the jumper. Similarly, if the jumper had extended more horizontally, after the connector, a corresponding load would have been experienced, but in opposite direction.

A riser top connector 11 connects a jumper termination structure 13 to the riser tower assembly 7. At an end section of the flexible jumper 9, it is connected to a bend stiffener 15, which restricts the bending of the flexible jumper 9 in the proximity of the jumper termination structure 13. The bend stiffener 15 connects to the jumper termination structure 13 along a jumper termination axis 6 along which the flow path of the jumper end section follows.

Figure 2:
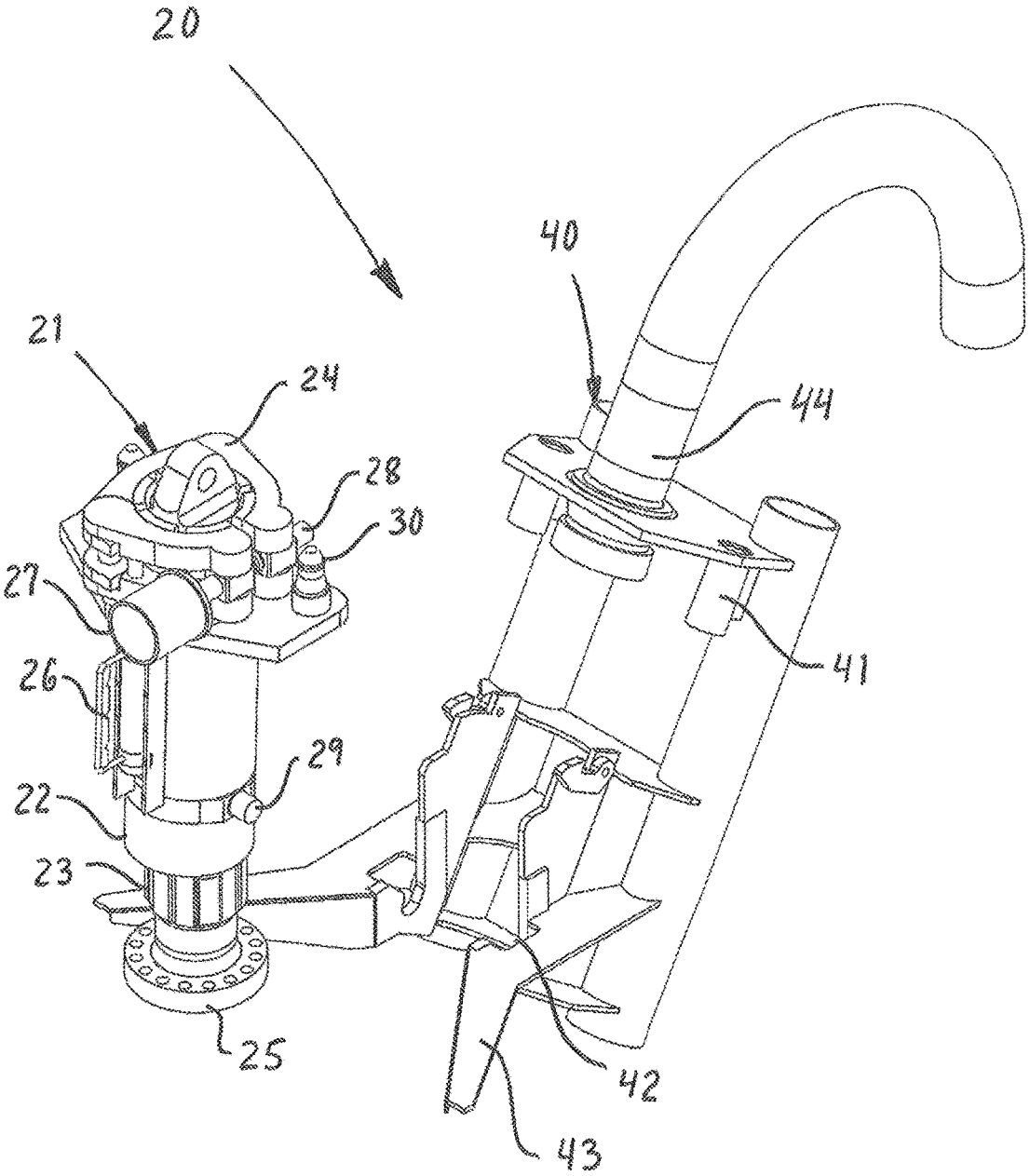
FIG. 2 is a perspective view of a jumper termination structure approaching a riser tower assembly.

FIG. 2 shows a detailed perspective view of a riser top connector assembly 20 according to the present invention, replacing the prior art riser top connector 11 shown in FIG. 1.

The previous jumper termination structure 13 is now termed a first connector part 21, which include a first connector part housing 22 that receives an extendable jumper termination hub 23 and a clamp connector 24 attached to the termination hub 23. A flange 25 is shown in the lower end the termination hub 23, to which the jumper (not shown) extending to the FPSO is to be secured.

An actuator, here shown as a stroke tool 26, is designed to act between the first connector part housing 22 and the jumper termination hub 23 in order to enable extension of the termination hub 23 out of the first connector part housing 22. Such stroke tool could be of any conceivable nature, preferably hydraulically operated.

A tool adapter 27 is arranged on the clamp connector 24. The tool adapter 27 is normally operated by a torque tool (not shown) carried by an ROV when in use and submerged. The tool adapter 27 is connected to a screw 28, which, when turned, is able to reduce the opening diameter of the clamp connector 24 in order to pull the respective hubs to engagement.

The first connector part housing 22 includes a pair of diametrically located and projecting journals 29 designed to pivotally suspend the first connector part 21 in a second connector part 40.

Figure 12:
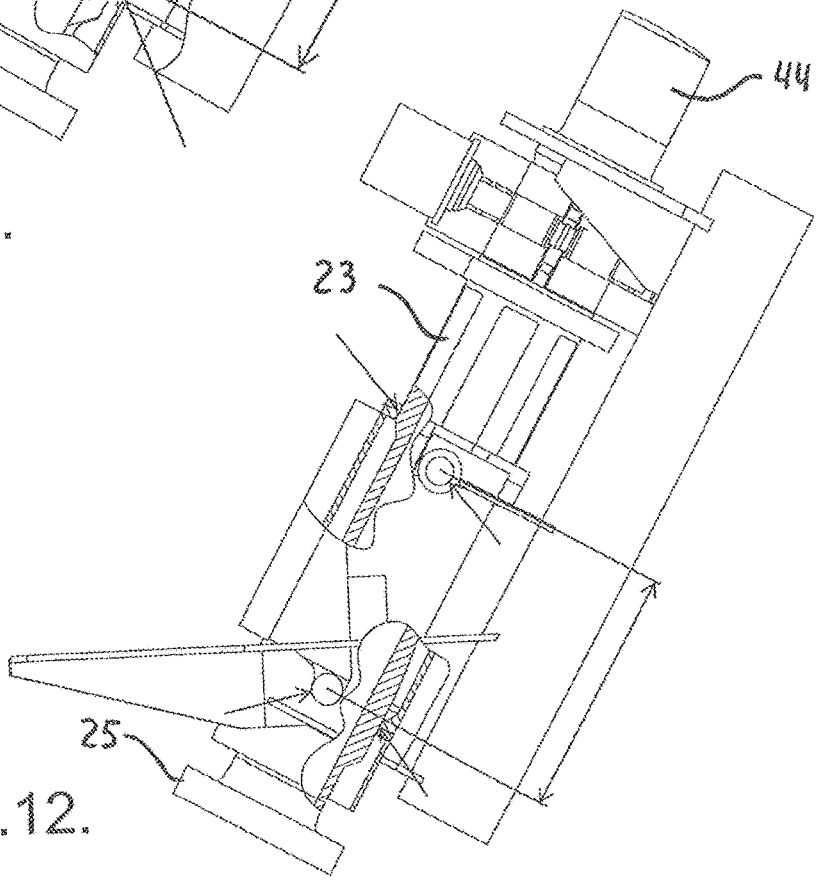
FIG. 12 is a perspective view similar to FIG. 11, where the load transfer is illustrated by arrows, and is a "short arm to react bending moment" version.

The first connector part housing 22 also includes a pair of upwards projecting guide pins 30 designed to mate with receptacles 41 in the second connector part 40. In a second embodiment, as illustrated in FIG. 12, the guide pins and receptacles are omitted.

The riser top connector assembly 20 includes the second connector part 40 that initially is separate from the first connector part 21. Together the first and second connector part 21, 40 constitute the riser top connector assembly 20.

Figure 3:
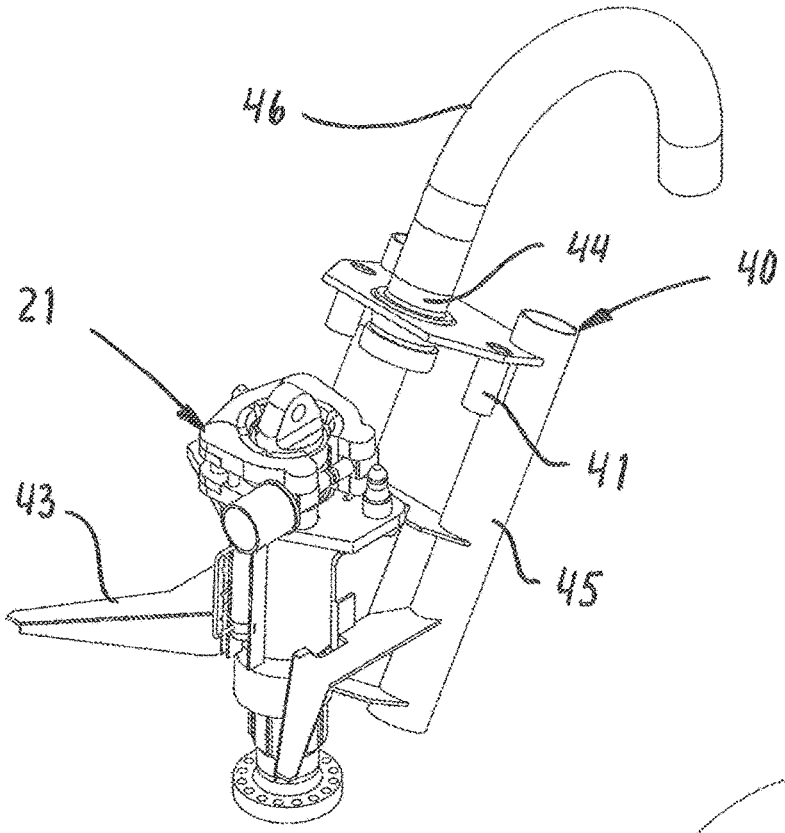
FIG. 3 is a perspective view similar to FIG. 2, where the jumper termination structure is about to land on the riser tower assembly.

The second connector part 40 includes supporting means in the form of cradles 42 able to receive the projecting journals 29 arranged on the first connector part housing 22. FIG. 3 shows the situation where the projecting journals 29 are approaching the cradles 42 for final support therein when completely installed.

Figure 4:
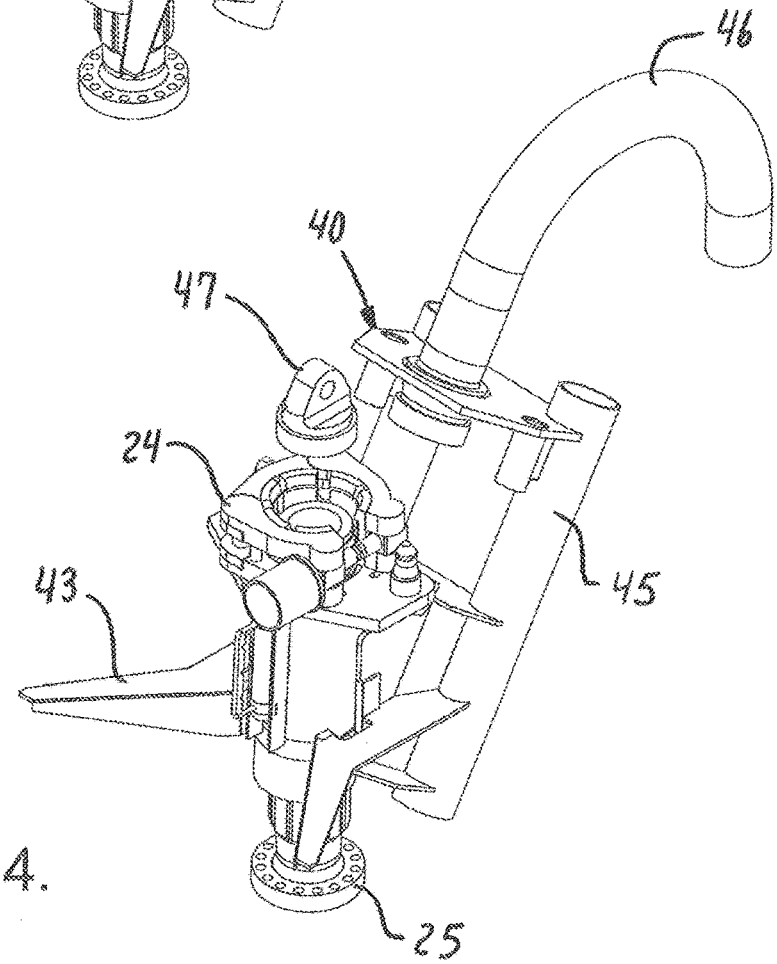
FIG. 4 is a perspective view similar to FIG. 3, where the jumper termination structure is landed on the riser tower assembly and a fluid cap is being recovered.

The second connector part 40 further includes receiving means 43 enabling guiding of the first connector part 21 into correct positioning and engagement with the second connector part 40 as illustrated in FIGS. 2 and 3. FIG. 4 shows the situation when the first connector part 21 is fully seated in the supporting means of the second connector part 40 and ready to tilt for aligning the respective termination hub 23 and riser hub 44.

The second connector part 40 has a frame structure 45 which also have the material function to remove the bending moment between the hubs 23, 44 and have them transferred to the frame structure 45. The riser hub 44 is the termination end of the riser 5 that in this end portion extends like a gooseneck section 46. This end portion is axially retained to the frame structure 45 near the riser hub 44. The riser hub 44 is freely projecting from the frame structure 45.

Further, FIG. 4 also indicates the recovery of a cap 47 from the fluid passage of the first connector part 21, which normally will take place shortly before the first and second connector parts 21, 40 are to be connected.

Figure 5:
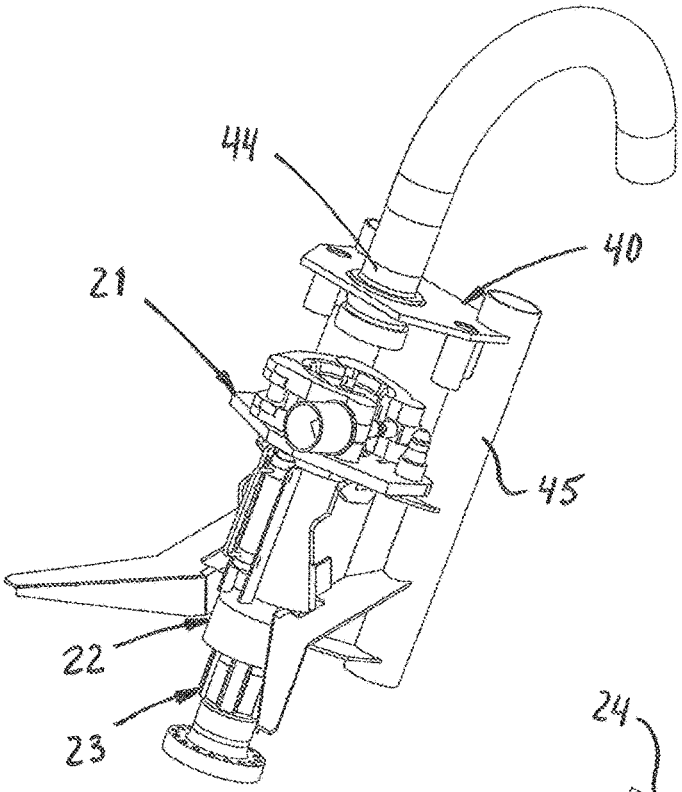
FIG. 5 is a perspective view similar to FIG. 4, where the jumper termination structure is tilted and coarsely aligned with a riser hub of the riser tower assembly, still without the mating of the components of the riser top connector assembly.

FIG. 5 indicates that the first connector part has been rotated, or tilted, in order to coarsely align the termination hub 23 with the riser hub 44. The respective hubs 23, 44 are still a distance apart from each other, but, as stated, coarsely aligned.

Such rotation may be performed by either moving the installation vessel a little, or pulling in some jumper length into the installation vessel. In this way the termination hub will tilt and finally lock as described in more detail with reference to FIGS. 7 and 11. An option will be to install a tool or actuator to forcibly make such tilting motion.

Figure 6:
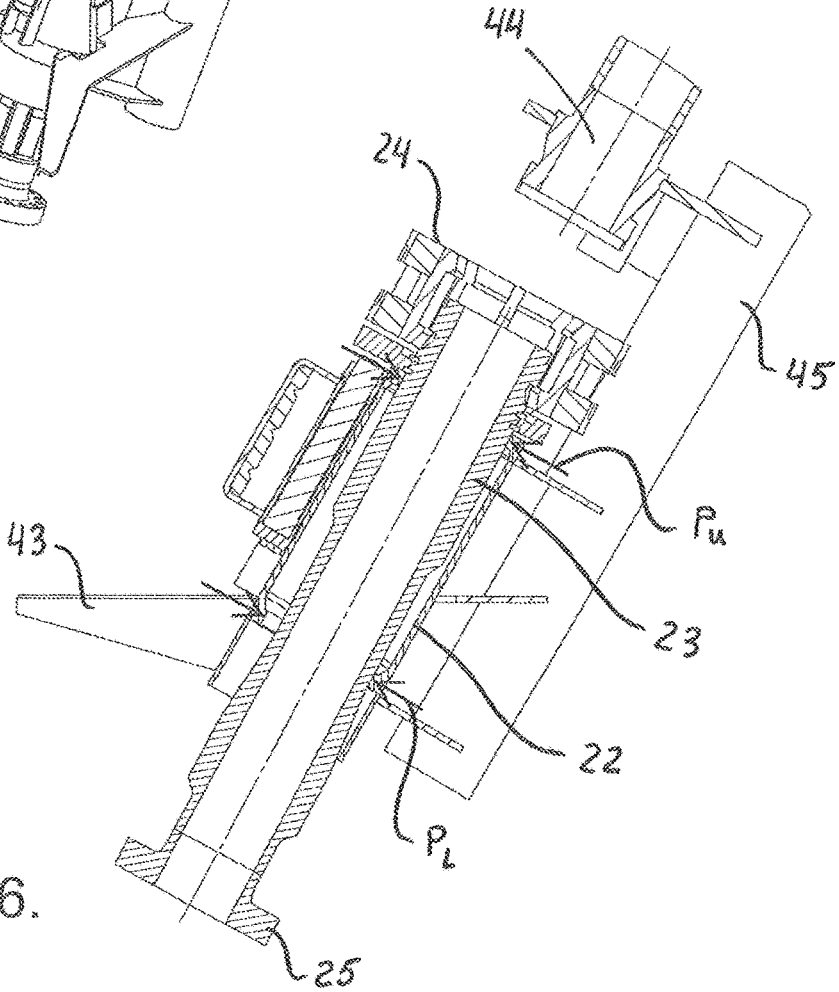
FIG. 6 is a cross section and partly elevation view of the riser top connector assembly, still without the mating of the components, illustrating centralization between the components.

As shown in FIG. 6, the termination hub 23 is allowed some angular movement inside the termination housing 22, or termination sleeve. This is illustrated with upper and lower arrow pairs $P_U$ and $P_L$. The upper arrow pair PU indicates only minor tolerances between termination hub 23 and the termination housing 22, while the lower arrow pair PL indicates larger tolerances between the termination hub 23 and the termination housing 22. Thus, angular movement of the termination hub 23 inside the termination housing 22 is allowed.

Figure 7:
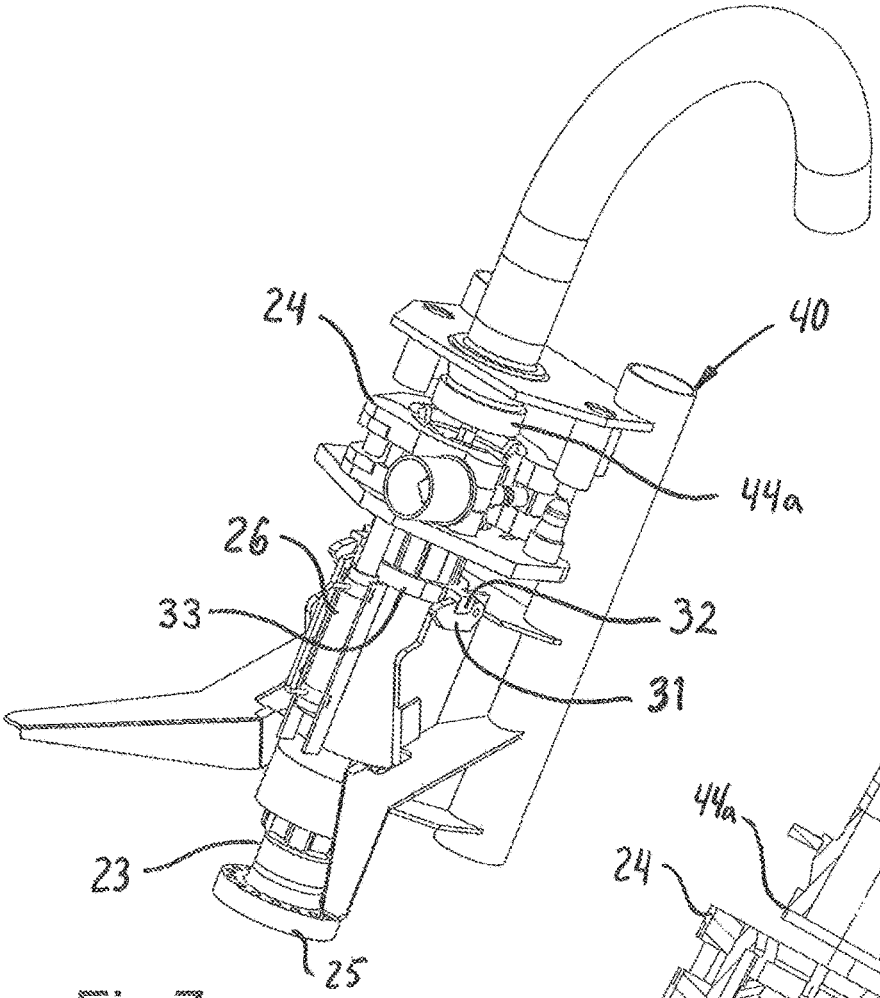
FIG. 7 is a perspective view similar to FIG. 5, where a stroke tool is activated to extend a termination hub carrying a clamp connector out from a first connector housing towards the riser hub.

FIG. 7 shows the stroke of the stroke tool 26 stroking the termination hub 23 towards the riser hub 44. The clamp connector 24 is kept in a fully opened position ready to receive the riser hub end flange 44*a*.

A locking arrangement is also clearly shown in FIG. 7. Two pivotable and gravity or spring biased locking pawls 31 are arranged on the frame structure 45 of the second connector part 40. Two projecting pins 32 are in turn arranged on a rim 33 near the top of the termination housing 22. During the tilting movement of the first connector part 21 towards the second connector part 40, as partly illustrated in FIG. 5, the two locking pawls 31 are cammed down by the projecting pins 32. This can also be understood from FIG. 11. The tip of each pawl 31 has an inclined leading surface 34, which is hit by the projecting pin 32 and pushes the pawl 31 downwards against the spring bias. The tip of the pawl 31 also have a notch 35 at the end of the inclined surface 34. As soon as the projecting pin 32 has passed the inclined surface 34, the locking pawl 31 is biased upwards and catches the projecting pin 32 in the notch 35 and the two connector parts are thereby locked to each other. The locking pawl 31 has to be pivoted downwards again to release the connector parts 21, 40 from each other.

Figure 8:
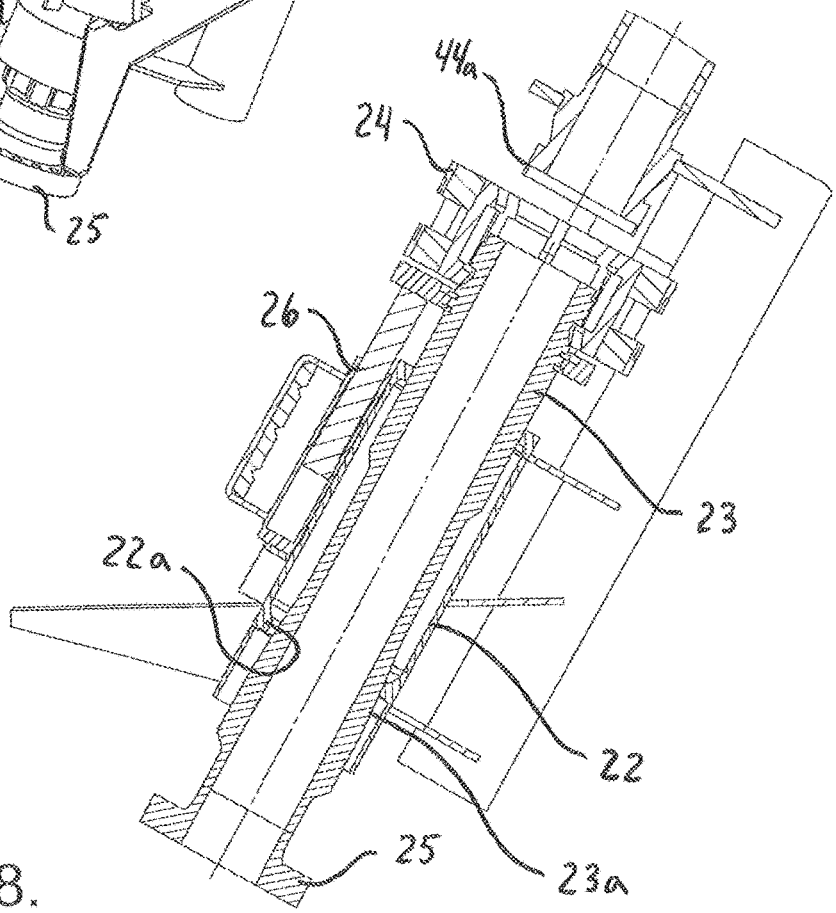
FIG. 8 is a cross section and partly elevation view similar to FIG. 6, of the riser top connector assembly, still without the mating of the components, illustrating further centralization between the components.

FIG. 8 shows how the termination hub 23 "straightens" as the hub 23 is being moved inside the termination housing 22 towards the riser hub 44. The "straightening" action takes place because of the tapering external surface 23*a* of the termination hub 23 contacting the ledge 22*a* arranged in the lower region of the internal surface of the termination housing 22. The pair of upwards projecting guide pins 30 are now about to mate with the receptacles 41 in the second connector part 40, thus making the final alignment between the termination hub 23 and the riser hub 44.

Figure 9:
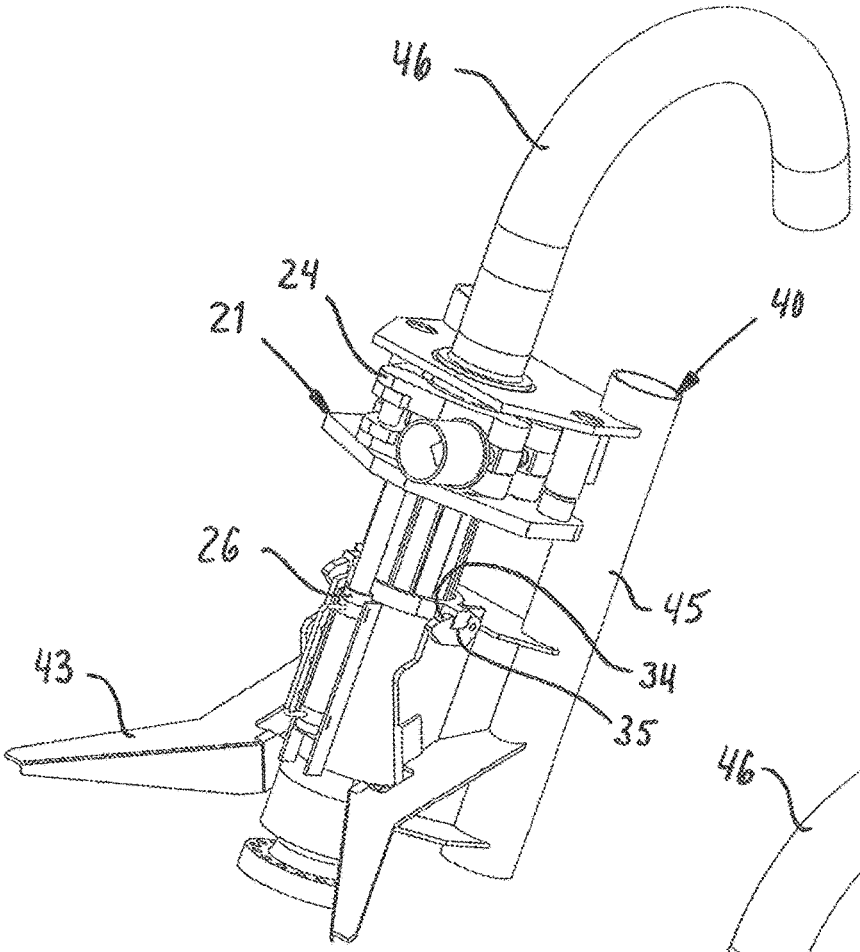
FIG. 9 is a perspective view similar to FIG. 7, where the stroke tool is totally extended to extend the termination hub with the clamp connector till engagement with the riser hub.

FIG. 9 shows the finished stroking of the stroke tool 26, where the termination hub 23 abuts the riser hub 22 and with a seal therebetween. The clamp connector 24 is activated by the ROV tool to pull the respective hubs 23, 44 towards each other to make up a sealed fluid connection.

Figure 10:
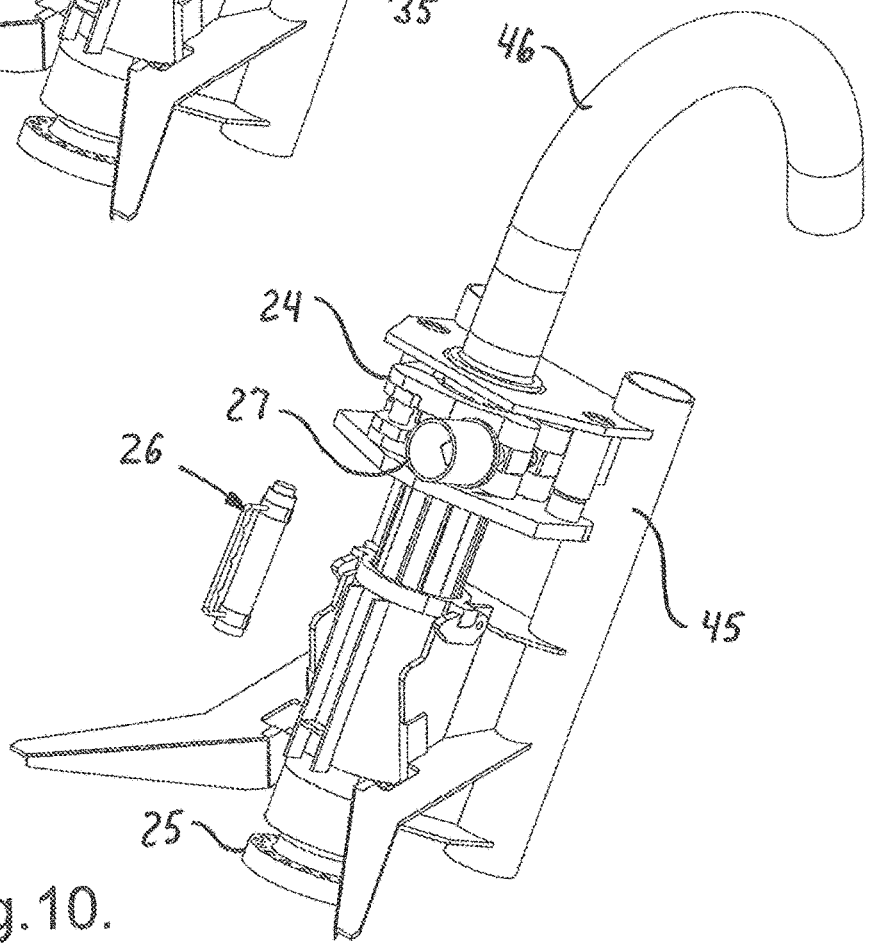
FIG. 10 is a perspective view similar to FIG. 9, where the stroke tool is detached from the riser top connector assembly to be recovered to the surface.

FIG. 10 shows the recovery of the stroke tool 26 after the connection is completed.

Figure 11:
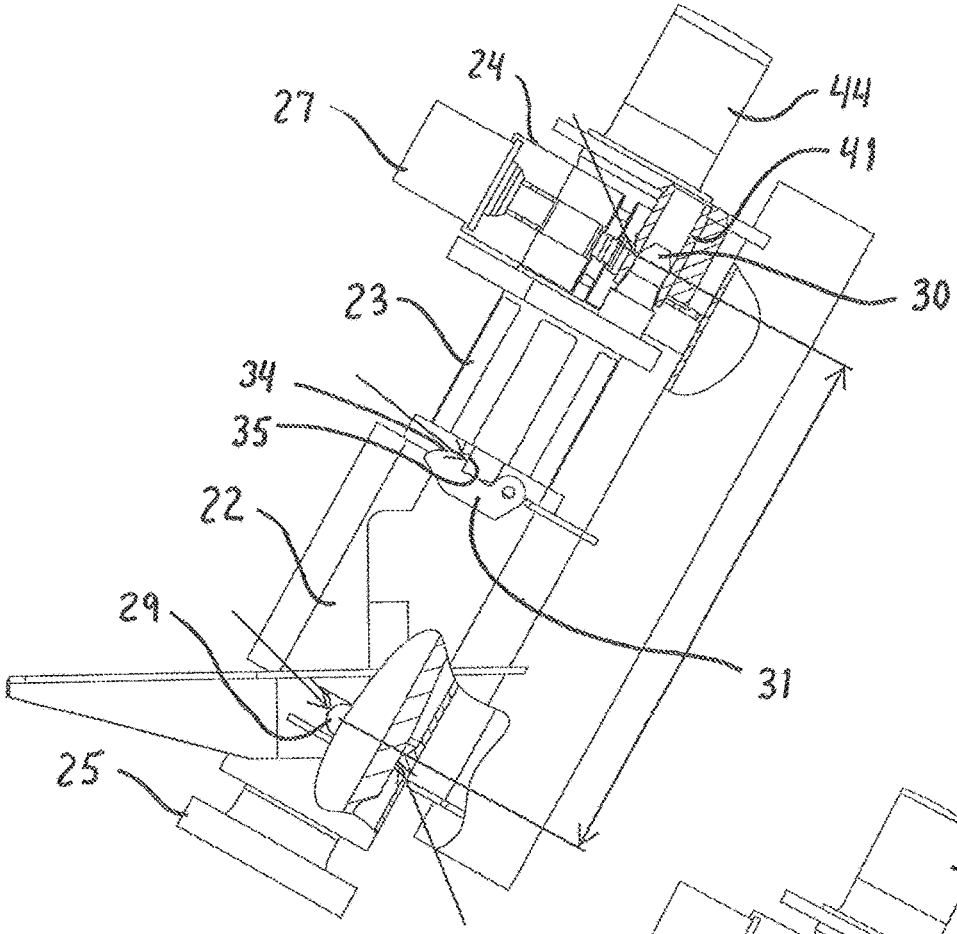
FIG. 11 is a perspective view similar to FIG. 8, where the load transfer is illustrated by arrows, and is a "long arm to react bending moment" version.

FIGS. 11 and 12 show two concepts for the load transfer between the jumper 9 and the riser 5, where such load transfer takes place external of the respective hubs 23, 44. The FIG. 12 embodiment makes the alignment between the hubs 23, 44 as described in the first part of the FIG. 8 description, i.e. there are no guide pins and receptacles present.

The FIG. 11 concept shows the two guide pins 30 on the termination hub 23 received in the respective receptacles 41 on the riser hub 44. The forces applied by the bending moment will be transferred into the frame structure 45 through these guide pins 30 and the tilting point in the lower part of the termination hub 23. In this way a longer length between the force transfer points into the structure is obtained. This entails in the advantage that the forces prevailing at these two points are getting smaller. The disadvantage with such solution is that it is a bit more complicated and thus more expensive to manufacture.

The concept shown in FIG. 12 transfer the forces through the tilting point at the bottom of the termination hub 23 and the locking point on top of the hub 23. This is a somewhat simpler solution. However, since the distance between the two contact points are less, the forces in each point will increase compared with the previous solution.

For both solutions it is imperative that the riser hub 44 (upper) is retained to the frame structure 45 in axial direction, but is allowed to move in radially direction. The riser hub 44 is also allowed to twist a little relative to nominal axial direction. In this way the riser hub 44 will give in when the bending moment from the flexible jumper 9 is received, and the jumper end is moving until resistance is received from the termination hub 23 or the guide pins. A great part of the bending moment and the shear force is thus taken up by this contact instead of being transferred through the hubs and the connector to the riser. All this is provided that the gooseneck and the upper part of the riser have some certain flexibility. This is solved in that a certain length is present from the riser hub to where the riser is supported.

The invention claimed is:

1. A riser top connector assembly comprising:

a first connector part arranged on a flexible jumper prepared for connection with a second connector part arranged on top of a marine riser tower assembly projecting from a seabed, said first connector part comprises a housing adapted to receive an extendable jumper termination hub having a connector attached thereto, said jumper termination hub is alignable with a freely projecting riser hub on the second connector part;

an actuator adapted to act between the jumper termination hub and the housing to extend the jumper termination hub towards the second connector part;

wherein the jumper termination hub is, when extended from the first connector part housing, prepared for connection with the riser hub via the connector;

wherein the second connector part comprises a load carrying frame structure, said load carrying frame structure extends over respective hubs and is secured at the second connector part near each end of the hubs when said hubs are connected in order to remove bending moment between the hubs and route a load path away from the hubs and the riser top connector assembly; and wherein the first connector part comprises a journal and the second connector part comprises a cradle, the journal landed in the cradle to pivotally suspend the first connector part from the second connector part.

2. The riser top connector assembly according to claim 1, wherein the connector is a clamp connector, a collet connector or a dog type connector.

3. The riser top connector assembly according to claim 1, wherein the actuator, being able to extend the jumper termination hub from the first connector part housing, is either a stroke tool or a pulling tool.

4. The riser top connector assembly according to claim 1, wherein the jumper termination hub is externally designed with a first centralizing part in which centralizing takes place and being performed during an extending motion of the jumper termination hub within and relative to the first connector part housing.

5. The riser top connector assembly according to claim 1, wherein the first connector part housing is internally designed with a second centralizing part in which centralizing takes place and being performed during an extending motion of the jumper termination hub within and relative to the first connector part housing.

6. The riser top connector assembly according to claim 1, wherein the first connector part comprises a first projecting orienting part and the second connector part comprises a second projecting orienting part, said first and second projecting orienting parts are adapted to mate and engage during final relative motion between the first and second connector parts.

7. The riser top connector assembly according to claim 3, wherein the stroke tool is removably arranged on the first connector part housing and jumper termination hub.

8. The riser top connector assembly according to claim 1, wherein the connector is operable via a torque tool and an ROV.

9. The riser top connector assembly according to claim 1, wherein the first connector part housing is configured to omit an orienting part and is internally designed with a second centralizing part in which centralizing takes place and being performed during an extending motion of the jumper termination hub within and relative to the first connector part housing.

10. The riser top connector assembly according to claim 1, wherein the riser top connector assembly includes a locking arrangement for securely locking the respective connector parts to each other after landing of the first connector part into the second connector part.

11. The riser top connector assembly according to claim 1, wherein the load carrying frame and the housing are adapted to be connected in at least one releasable connection.

12. The riser top connector assembly according to claim 1, wherein the first connector part housing comprises guide pins adapted to mate with receptacles arranged on the second connector part.

* * * * *